US009482503B2

(12) United States Patent
Tippmann, Jr. et al.

(10) Patent No.: US 9,482,503 B2
(45) Date of Patent: Nov. 1, 2016

(54) PAINTBALL GRENADE

(71) Applicant: TIPPMANN SPORTS, LLC, Fort Wayne, IN (US)

(72) Inventors: Dennis J. Tippmann, Jr., Fort Wayne, IN (US); Corey K. Rice, Fort Wayne, IN (US); Ricky Reader, Paulding, OH (US)

(73) Assignee: Tippmann Sports, LLC, Fort Wayne, IN (US)

( * ) Notice: Subject to any disclaimer, the term of this patent is extended or adjusted under 35 U.S.C. 154(b) by 0 days.

(21) Appl. No.: 14/595,828

(22) Filed: Jan. 13, 2015

(65) Prior Publication Data

US 2015/0198428 A1 Jul. 16, 2015

Related U.S. Application Data

(60) Provisional application No. 61/927,764, filed on Jan. 15, 2014.

(51) Int. Cl.

| | |
|---|---|
| ***F42B 8/26*** | (2006.01) |
| ***F42B 12/40*** | (2006.01) |
| ***F42B 27/00*** | (2006.01) |
| *F41B 9/00* | (2006.01) |

(52) U.S. Cl.

CPC ..... *F42B 8/26* (2013.01); *F42B 12/40* (2013.01); *F42B 27/00* (2013.01); *F41B 9/0034* (2013.01)

(58) Field of Classification Search

CPC ..... F42B 8/26; F42B 12/40

USPC ..... 102/368

See application file for complete search history.

(56) References Cited

U.S. PATENT DOCUMENTS

| | | | | |
|---|---|---|---|---|
| 3,785,569 | A * | 1/1974 | Helmrich | 239/337 |
| 4,932,672 | A * | 6/1990 | Tippmann | 473/611 |
| 6,598,807 | B1 * | 7/2003 | Anzalone | 239/302 |
| 7,565,866 | B1 * | 7/2009 | Downes | 102/482 |
| 2004/0127311 | A1 * | 7/2004 | Brock | 473/577 |
| 2008/0257193 | A1 * | 10/2008 | Siu et al. | 102/498 |

* cited by examiner

*Primary Examiner* — Troy Chambers
*Assistant Examiner* — Joshua Semick
(74) *Attorney, Agent, or Firm* — Barnes & Thornburg LLP

(57) ABSTRACT

A paintball grenade that disperses a marking fluid upon impact. In one embodiment, the paintball grenade includes a flexible, resilient tube sealed at both ends. The tube includes a distended portion containing pressurized marking fluid and a side discharge port for discharging the marking fluid along a discharge axis that is approximately transverse to a longitudinal axis of the tube. A blocking member is disposed in the tube that is movable between a closed position that prevents fluid communication between the distended portion of the tube and the discharge port and an open position that allows fluid communication between the marking fluid and the discharge port. When the paintball grenade is thrown and impacts an object, this results in hydrostatic shock through the marking fluid, which moves the blocking member from the closed position to the open position, thereby discharging the marking fluid through the discharge port onto surrounding objects.

20 Claims, 6 Drawing Sheets

PAINTBALL GRENADE

RELATED APPLICATIONS

The present application is related to and claims priority to U.S. Provisional Patent Application Ser. No. 61/927,764, filed on Jan. 15, 2014, entitled "Paintball Grenade," which is hereby expressly incorporated by reference into the present application in its entirety.

TECHNICAL FIELD

This invention relates generally to marking devices and more particularly to a nonlethal hand grenade that dispenses a marking fluid upon impact.

BACKGROUND AND SUMMARY

Devices that fire frangible projectiles are known in the art. For example, marking guns (commonly known as paintball guns or markers) typically use compressed gas to propel frangible projectiles. The frangible projectiles commonly have a gelatinous or plastic shell designed to break upon impact. Typically, the shells are filled with a marking material, such as paint, and/or an immobilizing material, such as a noxious chemical.

These types of devices have a wide variety of applications. For example, a popular recreational use is in paintball games, in which opposing sides attempt to seek out and "shoot" one another with paintballs. Likewise, law enforcement personnel employ frangible projectiles with immobilizing materials for crowd control.

In addition to paintball markers, other marking devices exist that disperse a marking fluid. For example, paintball grenades are often used in paintball games as another way to target the opposing side. Paintball grenades typically have a bladder filled under pressure with a marking fluid that discharges upon impact.

U.S. Pat. No. 4,932,672 for a "Nonlethal Hand Grenade" describes an example paintball grenade with an elastic tube filled under pressure with a marking fluid. The tube has an open end through which the marking fluid discharges upon impact. Prior to being thrown, the open end of the tube is folded over and a ball is retained inside the tube to prevent discharge. When the pin is released, the open end of the tube is supposed to straighten. The ball dislodges upon impact so that marking fluid is discharged out the open end of the tube. One problem with this type of design is that the open end of the tube may not fully straighten when the pin is removed due to the tube remaining in the folded position for an extended period of time prior to use. Instead, the open end may remain somewhat kinked, which narrows the passageway through which the marking fluid can be discharged. If this happens, this can lead to a shortened discharge distance and unsatisfactory spray pattern.

According to one aspect, the present invention provides a paintball grenade that disperses a marking fluid upon impact. In one embodiment, the paintball grenade includes a flexible, resilient tube sealed at both ends. The tube includes a distended portion containing pressurized marking fluid and a side discharge port for discharging the marking fluid along a discharge axis that is approximately transverse to a longitudinal axis of the tube. A blocking member is disposed in the tube that is movable between a closed position that prevents fluid communication between the distended portion of the tube and the discharge port and an open position that allows fluid communication between the marking fluid and the discharge port. When the paintball grenade is thrown and impacts an object, this results in hydrostatic shock through the marking fluid, which moves the blocking member from the closed position to the open position, thereby discharging the marking fluid through the discharge port onto surrounding objects.

In some embodiments, the paintball grenade could include a lever assembly proximate the first end of the tube. The lever assembly may have an internal cavity dimensioned to receive at least a portion of the tube. For example, the first end of the tube could be folded over in the cavity. In some cases, the lever assembly includes a first member pivotally coupled with a second member. Some embodiments include a pin that is pulled from the lever prior to throwing the paintball grenade. For example, the first member may have a hole that is alignable with a hole in the second member and the pin could extend through the holes to prevent pivoting therebetween prior to the grenade being thrown. Depending on the circumstances, the first end of the tube may be folded around the pin. Typically, due to the resiliency of the tube, the first end of the tube urges the first member to pivot with respect to the second member.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
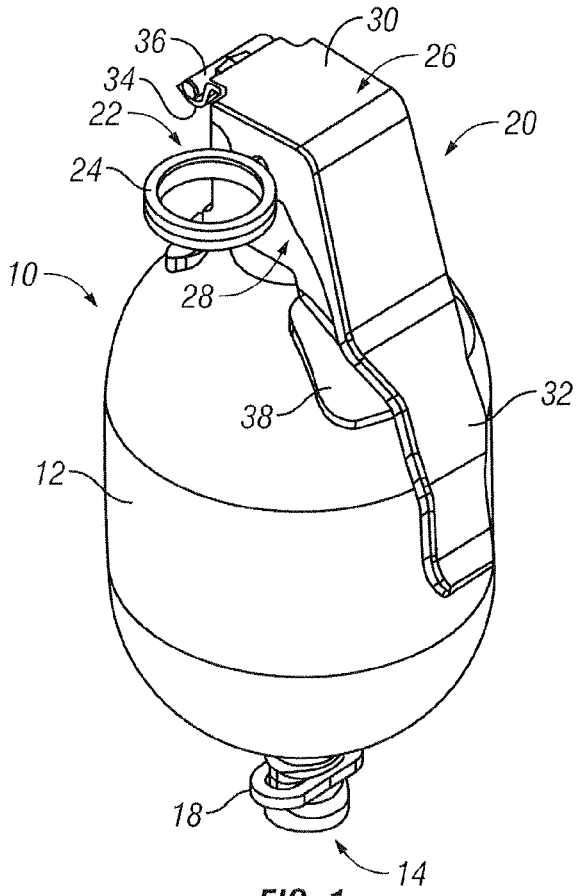
FIG. 1 is a perspective view of an example paintball grenade according to one aspect of the disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

Figure 3:
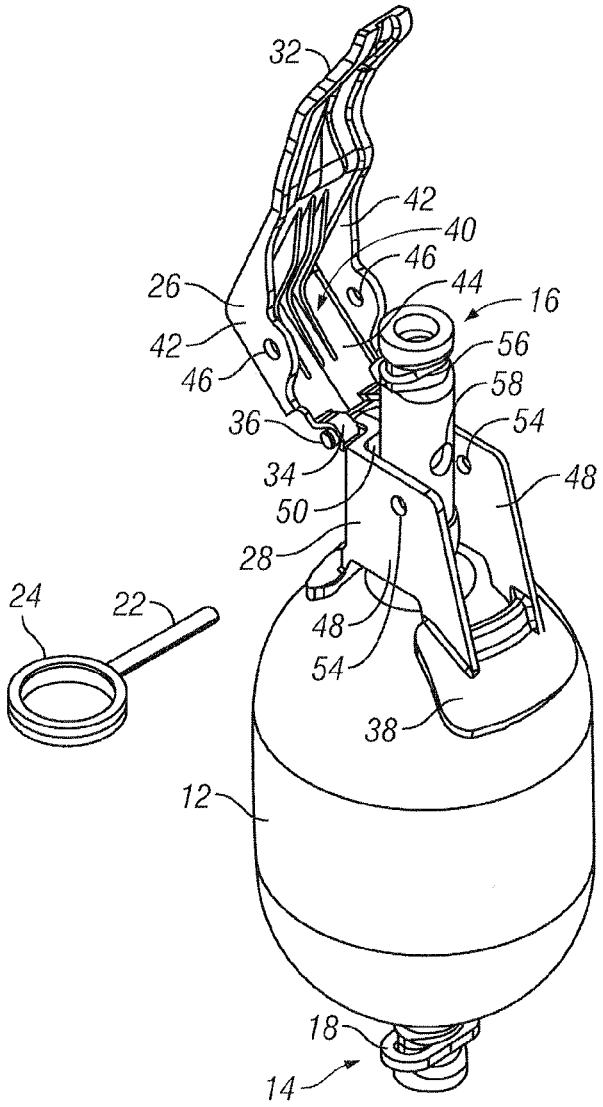
FIG. 3 is a perspective view of the example paintball grenade shown in FIG. 2 with the lever portion pivoted to an open position.
Figure 4:
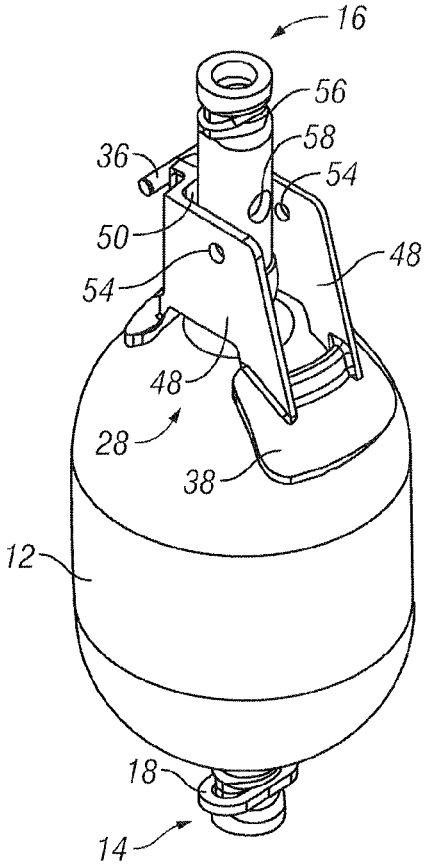
FIG. 4 is a perspective view of the example paintball grenade shown in FIG. 3 with the lever portion removed.

FIG. 1 is a perspective view of an example paint ball grenade 10 according to an embodiment of this disclosure. In the example shown, the grenade 10 is formed from a flexible, resilient tubular material. As shown, the tube 12 includes a distended portion filled under pressure with a marking fluid between a first sealed end 14 and second sealed end 16 (FIGS. 3 and 4). In the embodiment shown, the sealed ends 14, 16 are crimped by clips 18, 56 but other devices for preventing discharge through the closed ends could be used.

In the example shown, the grenade 10 includes a lever assembly 20 that opens when a pin 22 is removed from the lever assembly 20 due to urging of the tube 12 to straighten. In the example shown, the pin 22 includes a ring 24 into which a user's finger may be inserted to aid in pulling the pin 22 out of the lever assembly 20.

In the embodiment shown, the lever assembly 20 includes an upper portion 26 pivotally connected to a lower portion 28. The upper portion 26 pivots between a closed position (FIG. 1) and an open position (FIG. 3). As shown, the upper portion 26 includes a body 30 with a depending portion 32 that extends downwardly from the body 30. The depending portion 32 is shaped, in this example, to be gripped by the fingers of the user when the grenade 10 is thrown. The upper portion 26 includes arcuate fingers 34 extending from the body 30, which receive a pivot pin 36 extending from the lower portion 28 of the lever assembly 20. As explained below, the upper portion 26 and the lower portion 28 each include holes (FIG. 3) that are aligned in the closed position and configured to receive the pin 22. In the example shown, the lower portion 28 includes a depending portion 38 that is curved in this example to conform to the shape of the tube's 12 distended portion.

Figure 2:
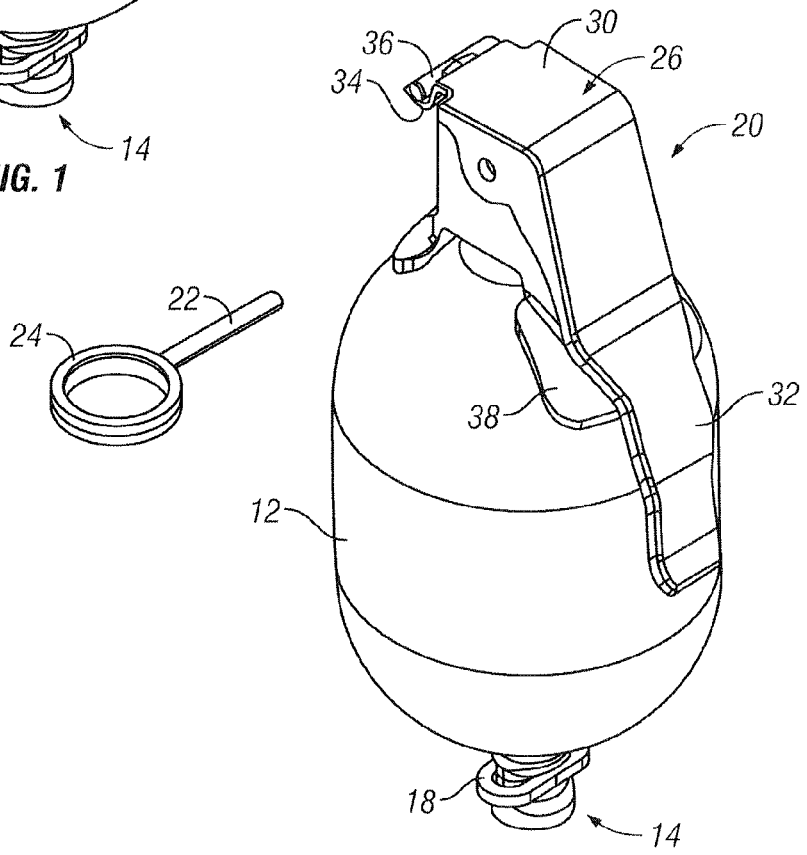
FIG. 2 is a perspective view of the example paintball grenade shown in FIG. 1 with the pin removed.

FIG. 2 is a perspective view of the example paintball grenade 10 shown in FIG. 1 with the pin 22 removed from the lever assembly 20. With the pin 22 removed, the upper portion 26 pivots to an open position (FIG. 3) in which the second end 16 of the tube can straighten as shown in FIG. 3. Prior to throwing the paintball grenade, the user would pull the pin 22, such as using the ring 24 to aid in pulling the pin 22 out of the lever assembly 20. The lever assembly 20 opens due to the urging of the second end 16 moving to straighten with the longitudinal axis of the tube 12 due to the resiliency of the material. Prior to the pin 22 being removed, the pin 22 locks the upper portion 26 with respect to the lower portion 28 since the pin 22 extends through the aligned holes in the upper portion and lower portion.

Referring to FIG. 3 in which the upper portion 26 has pivoted with respect to the lower portion 28, the body 30 of the upper portion 26 defines a cavity 40 for receiving the second end 16 of the tube 12. In this example, the body 30 includes side walls 42 and a top wall 44 that define the cavity 40. As shown, these side walls 42 include aligned holes 46 through which the pin 22 can extend.

The lower portion 28 includes side walls 48 and a back wall 50 which define a cavity 52 that is dimensioned to receive the second end 16 of the tube 12. In this example, the side walls 48 include aligned holes 54 that are dimensioned to receive the pin 22. When the upper portion 26 is rotated about the pivot pin 36 to the closed position, such as shown in FIGS. 1 and 2, the holes 46 in the side walls 42 of the upper portion 26 are aligned with the holes 54 in the side walls 48 of the lower portion 28 so that the pin 22 may extend through the holes 46, 54. With the pin 22 extended through the holes 46, 54, the upper portion 26 is locked with respect to the lower portion 28 and the second end 16 is folded over the pin 22 in the cavity 40 (see also FIG. 8).

Figure 5:
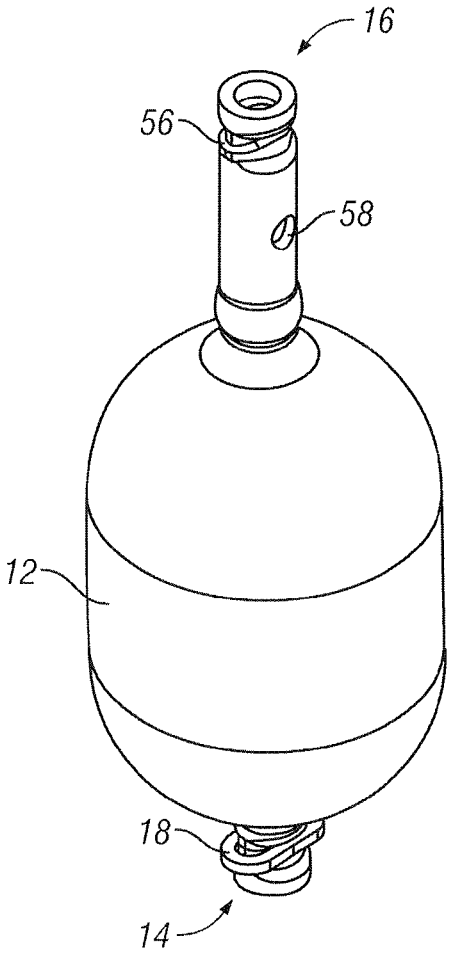
FIG. 5 is a perspective view of the example paintball grenade shown in FIG. 4 with the base portion removed.
Figure 6:
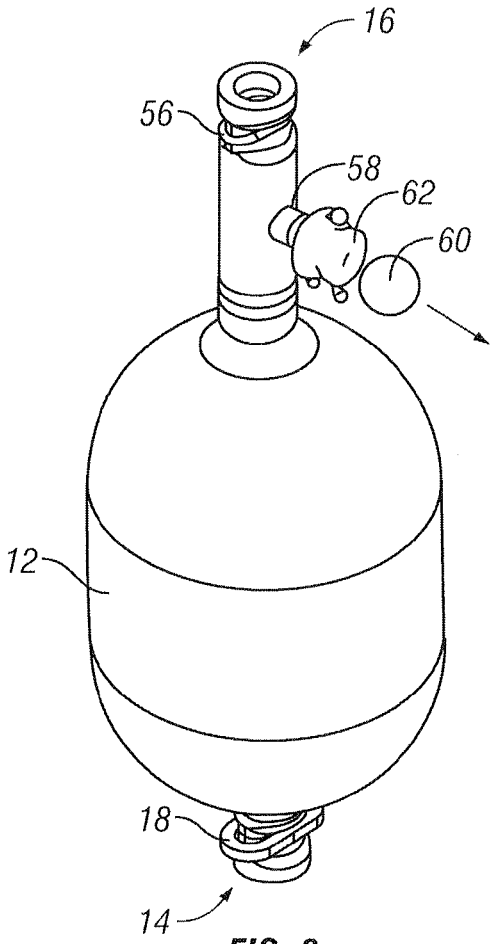
FIG. 6 is a perspective view of the example paintball grenade shown in FIG. 5 upon impact to discharge marking fluid.
Figure 8:
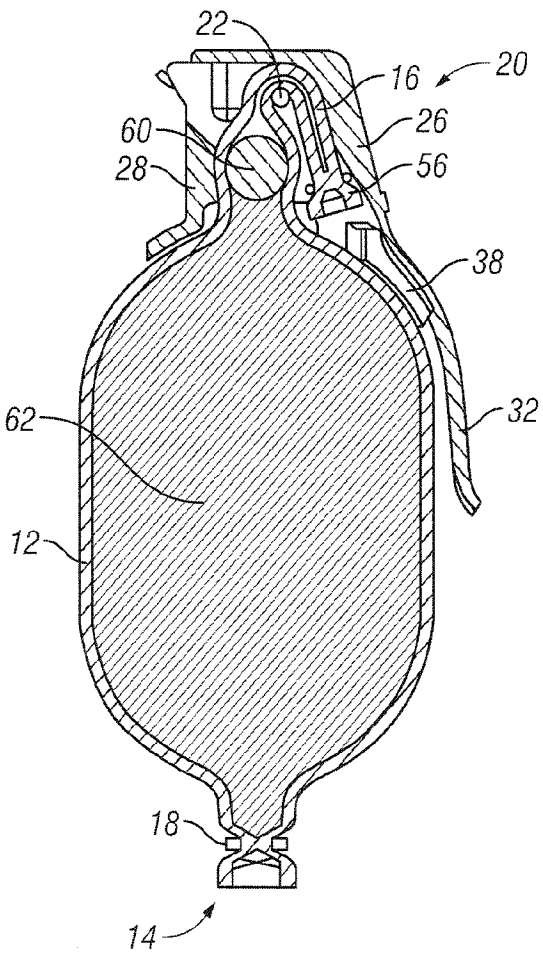
FIG. 8 is a cross-sectional view of the example paintball grenade shown in FIG. 7 along line 8-8.
Figure 12:
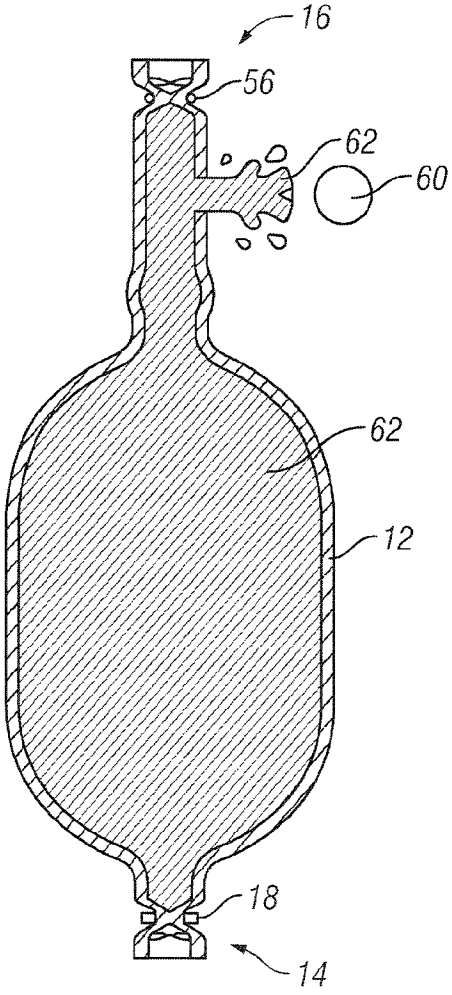
FIG. 12 is a cross-sectional view of the example paintball grenade shown in FIG. 11 along line 12-12.
Figure 11:
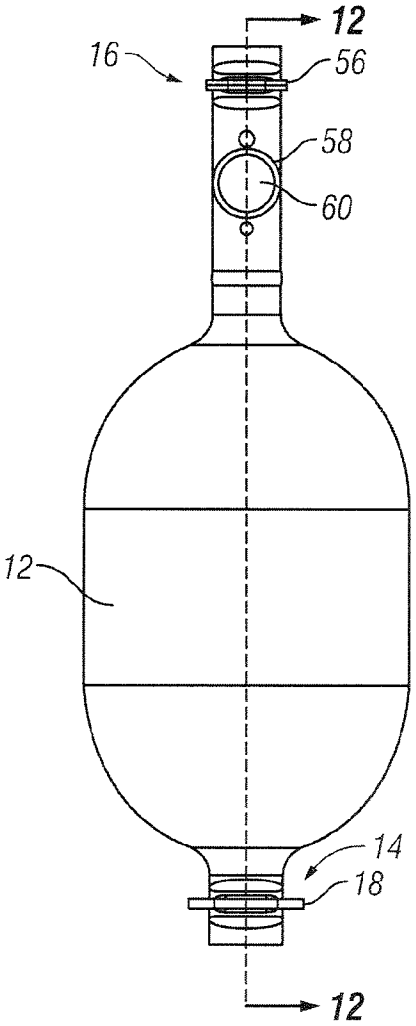
FIG. 11 is a front view of the example paintball grenade shown in FIG. 6.

The tube 12 defines a side discharge port 58 through which marking fluid is dispersed when a blocking member 60 moves beyond the discharge port 58 to allow the marking fluid to be dispersed (FIGS. 8 and 12). FIG. 4 shows the paintball grenade 10 with the upper portion 26 of the lever assembly 20 removed. FIG. 5 shows the tube 12 of the paintball grenade 10 with the lever assembly 20 removed. FIG. 6 shows the grenade 10 with marking fluid 62 being dispersed out of the discharge port 58.

Figure 7:
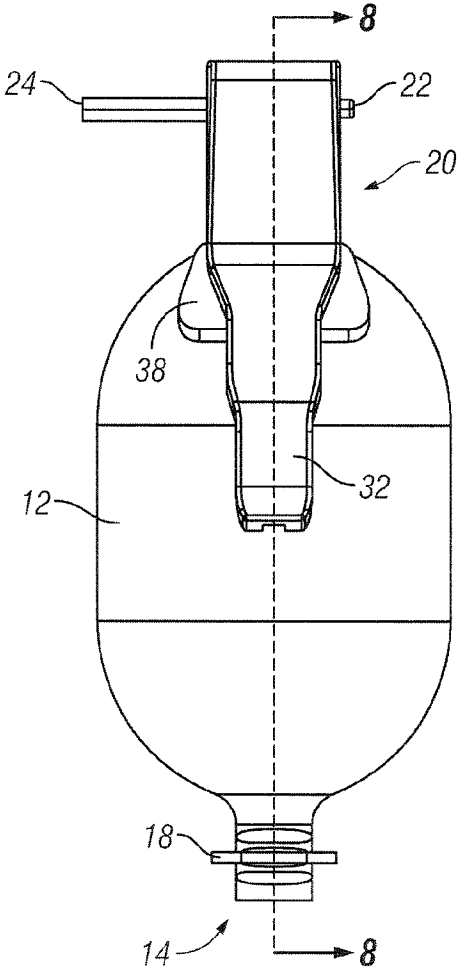
FIG. 7 is a front view of the example paintball grenade shown in FIG. 1.
Figure 10:
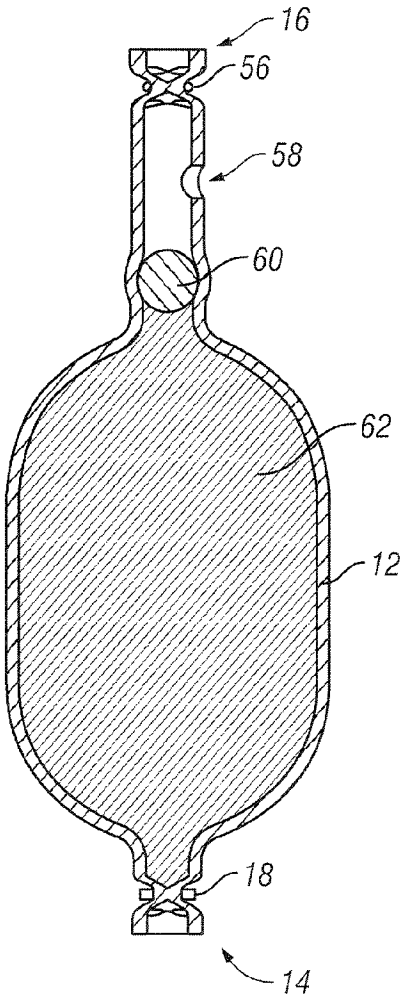
FIG. 10 is a cross-sectional view of the example paintball grenade shown in FIG. 9 along line 10-10.
Figure 9:
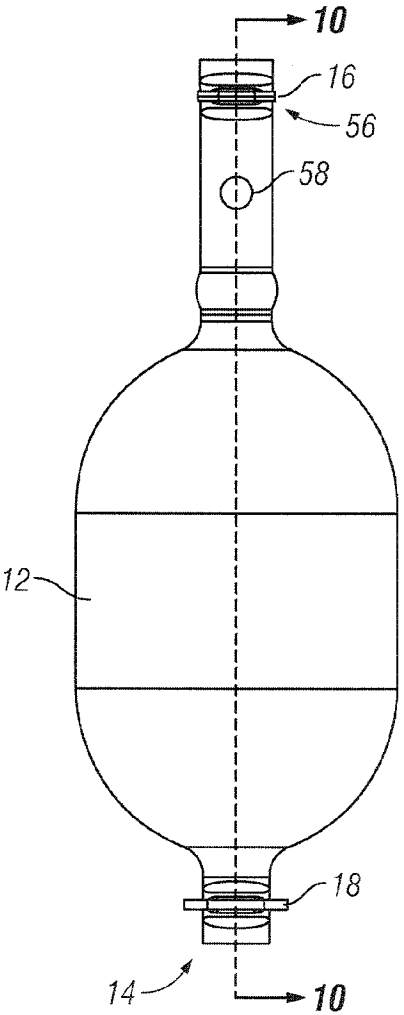
FIG. 9 is a front view of the example paintball grenade shown in FIG. 5.

Referring to FIGS. 7 and 8, there is shown a front view of the paintball grenade 10 and a side cross-sectional view along line 8-8 of FIG. 7, respectively. In this view, it can be seen that the second end 16 of the tube 12 is folded over the pin 22 in the cavity 40, 52 defined in the lever assembly 20. The blocking member 60, which is a ball in this example, prevents the marking fluid 62 from being discharged through the discharge port 58. For example, the blocking member could be sized larger than the interior diameter of the tube 12, thereby creating a frictional fit between the blocking member 60 and the interior surface of the tube 12. When the user would like to throw the grenade 10 and disperse the marking fluid 62, the user would pull the pin 22, which unlocks the upper portion 26 with respect to the lower portion 28 of the lever assembly 20, thereby straightening the second end 16 of the tube 12 to urge the upper portion 26 into an open position. Although the second end 16 of the tube 12 is straightened due to the resiliency of the material from which the bladder 12 is made, the marking fluid 62 does not discharge due to the frictional fit between the interior surface of the tube and the blocking member 60. As seen in FIGS. 9 and 10, some users may like to take the lower portion 28 off of the tube 12, prior to throwing the paintball grenade 10. Whether or not the user removes the lower portion 28 from the tube 12 is personal preference. In any event, even though the second end 16 of the tube 12 has straightened, the blocking member 60 prevents discharge of the marking fluid 62 out of the discharge port 58.

When the user throws the grenade 10, the grenade 10 will impact the ground (or other object) which results in hydrostatic shock applied to the blocking member 60 due to the pressurized marking fluid 62. If the hydrostatic shock on the blocking member 60 is sufficient, this will dislodge the blocking member 60 thereby allowing the marking fluid 62 to disburse out the discharge port 58. In some cases, the blocking member 60 will be forced out of the discharge opening 58 as shown in FIG. 12. However, the blocking member 60 merely needs to move past the discharge port 58 to allow fluid communication between the distended portion of the tube 12 and the discharge port 58. When fluid communication is opened between the distended portion and discharge port 58, this will result in the pressurized marking fluid 62 being dispersed out the discharge port 58.

In the embodiment shown, the discharge port extends transverse to the longitudinal axis of the tube 12. Since the discharge port 58 disperses marking fluid 62 along the transverse axis rather than along the longitudinal axis of the bladder 12, any narrowing of the tube's 12 passage from a kink will not impact the discharge of marking fluid since the marking fluid 62 does not need to travel the entire length of the tube 12. Moreover, a transverse discharge of the marking fluid results in a greater dispersion pattern of the marking fluid.

In use, the user will pull the pin 22 out of the lever assembly 20, which causes the upper portion 26 to pivot with respect to the lower portion 28. However, marking fluid 62 is not dispersed out of the side discharge opening 58 because the blocking member 60 prevents fluid communications between the distended portion of the tube 12 and the discharge opening 58. When the user throws the grenade, the impact of the grenade on the ground (or other object) results in hydrostatic shock applied to the blocking member 60. If this force has sufficient intensity, this will dislodge the blocking member 60 and disperse marking fluid 62 out the discharge opening 58.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed:

1. A paintball grenade comprising:

a flexible resilient tube of unitary construction including a distended portion containing pressurized marking fluid between a first sealed end crimped with a first clip and a second sealed end crimped with a second clip, wherein the tube defines a side discharge port configured to discharge the marking fluid along a discharge axis that is approximately transverse to a longitudinal axis of the tube;

a blocking member disposed in the tube, wherein the blocking member is movable between a closed position that prevents fluid communication between the distended portion of the tube and the side discharge port and an open position that allows fluid communication between the distended portion of the tube and the side discharge port;

whereby, when the paintball grenade is thrown and impacts an object, resulting hydrostatic shock through the marking fluid within the tube moves the blocking member from the closed position to the open position, allowing discharge of the marking fluid out of the side discharge port onto surrounding objects; and wherein the first sealed end and the second sealed end remain sealed subsequent to the blocking member moving from the closed position to the open position.

2. The paintball grenade as recited in claim 1, wherein the side discharge port is positioned between the first end and the second end.

3. The paintball grenade as recited in claim 2, further comprising a lever assembly proximate the first end of the tube, wherein the lever assembly includes a cavity dimensioned to receive at least a portion of the tube.

4. The paintball grenade as recited in claim 3, wherein the first end of the tube is folded over in the cavity.

5. The paintball grenade as recited in claim 4, wherein the lever assembly includes a first member pivotally coupled with a second member.

6. The paintball grenade as recited in claim 5, wherein the first member includes a hole alignable with a hole in the second member, wherein a pin extends through the hole in the first member and the hole in the second member to prevent pivoting of the first member with respect to the second member.

7. The paintball grenade as recited in claim 6, wherein the first end of the tube is folded around the pin in the cavity.

8. The paintball grenade as recited in claim 6, wherein the first end of the tube urges the first member to pivot with respect to the second member.

9. The paintball grenade as recited in claim 1, wherein the blocking member is generally spherical-shaped.

10. The paintball grenade as recited in claim 1, wherein the blocking member is coupled with an interior surface of the tube with a frictional fit.

11. The paintball grenade as recited in claim 10, wherein the blocking member is disposed between the marking fluid and the side discharge port in the closed position.

12. A method of discharging a paintball grenade, the method comprising the steps of:

providing a paintball grenade formed from a unitary length of flexible resilient tubing with a distended portion containing pressurized marking fluid between a first sealed end crimped with a first clip and a second sealed end crimped with a second clip, wherein the paintball grenade defines a side discharge port in the flexible resilient tubing between the first clip and the second clip configured to discharge the marking fluid along a discharge axis that is approximately transverse to a longitudinal axis of the tube, wherein the paintball grenade includes a blocking member blocking fluid communication between the distended portion and the side discharge port;

throwing the paintball grenade, wherein an impact of the paintball grenade on an object results in sufficient hydrostatic shock that moves the blocking member towards the first sealed end and the blocking member no longer blocks fluid communication between the distended portion and the side discharge port prior to the blocking member reaching the first sealed end.

13. The method as recited in claim 12, wherein the blocking member is generally spherical-shaped.

14. The method as recited in claim 12, wherein the blocking member is coupled with an interior surface of the tube with a frictional fit.

15. The method as recited in claim 12, wherein the tube is sealed on each end and the side discharge port is located between the sealed ends.

16. A paintball grenade comprising:

a flexible resilient tube having a first end crimped sealed by a first clip and a second end crimped sealed by a second clip and a distended portion between the sealed ends containing pressurized marking fluid, wherein the tube defines a side discharge port configured to discharge the marking fluid along a discharge axis that is approximately transverse to a longitudinal axis of the tube, wherein the side discharge port is positioned between the first clip and the second clip;

a blocking member disposed in the tube, wherein the blocking member is movable between a closed position that prevents fluid communication between the distended portion of the tube and the side discharge port and an open position that allows fluid communication between the distended portion of the tube and the side discharge port;

wherein the tube has a folded portion between the blocking member and the first sealed end that is proximate the side discharge port; and whereby, when the paintball grenade is thrown and impacts an object, resulting hydrostatic shock through the marking fluid within the tube moves the blocking member from the closed position to the open position, allowing discharge of the marking fluid out of the side discharge port onto surrounding objects.

17. The paintball grenade as recited in claim 16, further comprising a lever assembly proximate the second sealed end of the tube, wherein the lever assembly includes a cavity dimensioned to receive at least a portion of the tube.

18. The paintball grenade as recited in claim 17, wherein the lever assembly includes a first member pivotally coupled with a second member, wherein the first member includes a hole alignable with a hole in the second member, wherein a pin extends through the hole in the first member and the hole in the second member to prevent pivoting of the first member with respect to the second member.

19. The paintball grenade as recited in claim 18, wherein the pin extends through the folded portion of the tube.

20. The paintball grenade as recited in claim 19, wherein the first end of the tube urges the first member to pivot with respect to the second member.

* * * * *